US005809656A

United States Patent [19]

Lindberg

[11] Patent Number: 5,809,656

[45] Date of Patent: Sep. 22, 1998

[54] PAPER KNIFE

[76] Inventor: Ari Lindberg, Vuohipellontie 2 as 3, FIN-35100 Orivesi as, Finland

[21] Appl. No.: 776,433

[22] PCT Filed: Jul. 31, 1995

[86] PCT No.: PCT/FI95/00408

§ 371 Date: Jan. 28, 1997

§ 102(e) Date: Jan. 28, 1997

[87] PCT Pub. No.: WO96/04145

PCT Pub. Date: Feb. 15, 1996

[30] Foreign Application Priority Data

Aug. 2, 1994 [FI] Finland ..... U940394

[51] Int. Cl.[6] ..... B43M 7/00

[52] U.S. Cl. ..... 30/294; 30/289

[58] Field of Search ..... 30/289, 294, 317, 30/DIG. 3; D8/102

[56] References Cited

U.S. PATENT DOCUMENTS

| | | | |
|---|---|---|---|
| 436,189 | 9/1890 | Prosinger | 30/289 |
| 844,770 | 2/1907 | Bauer . | |
| 2,255,945 | 9/1941 | Shuler | 30/294 |
| 2,442,694 | 6/1948 | Keiser | 30/289 |
| 2,610,399 | 9/1952 | Adams et al. | 30/294 |
| 3,383,768 | 5/1968 | Hamilton | 30/294 |
| 3,824,688 | 7/1974 | Goffe | 30/294 |
| 4,455,894 | 6/1984 | Roberts | 30/317 |
| 5,561,905 | 10/1996 | Sherman | 30/294 |

FOREIGN PATENT DOCUMENTS

| | | |
|---|---|---|
| 28 10 104 | 9/1979 | Germany . |
| WO 90/04525 | 5/1990 | WIPO . |

*Primary Examiner*—Hwei-Siu Payer
*Attorney, Agent, or Firm*—Larson & Taylor

[57] ABSTRACT

A knife for cutting a fold in paper, especially designed for opening an envelope. At least one end of the knife has two adjacent body walls (6) with a blade portion (3) placed between them and guiding sections (7, 10) in the body to guide the fold while cutting. At least body walls (6) of the knife are made of transparent material or furnished with a control hole (12) to facilitate arrangement of tip (2) into a starting position for cutting.

5 Claims, 1 Drawing Sheet

PAPER KNIFE

FIELD OF THE INVENTION

This invention relates to a paper knife applicable as an envelope opener by means of which the envelope-closing fold is most conveniently opened.

BACKGROUND OF THE INVENTION

Previously known, from publication No. WO 9004525 , is a paper knife, the blade of which is protected in the body so that it cannot unintendenly hurt the user. The blade has a tip part, whose entering the envelope-closing fold is made still better by means of special flexible fingers.

The disadvantage of such an opening knife is that the user does not see whether the knife blade gets into the fold or not, as the device must always be held with the right side up in the hand upon cutting and the constructional length of the device is too short to attain a proper course in the cutting direction between device and envelope.

SUMMARY OF THE INVENTION

By means of a paper knife according to this invention a decisive improvement of the above presented disadvantages is reached.

The most significant advantage of this invention is that the material of the body walls, which protect the blade and the envelope fold, is transparent, whereat the blade and especially the location of its tip are visible when the blade tip is, at first, placed in the beginning of the fold. By means of a hole in the body, also a similar property is achieved. The constructional length of the knife is sufficient for an ergonomic grip and the fold can lean against the guiding surfaces of the knife and thus retain its cutting direction. The blades still remain well protected and so no involuntary damages can occur.

BRIEF DESCRIPTION OF THE DRAWINGS

In the following the invention is presented in detail with reference to the enclossed drawing, where.

DESCRIPTION OF THE PREFERRED EMBODIMENTS

Figure 1:
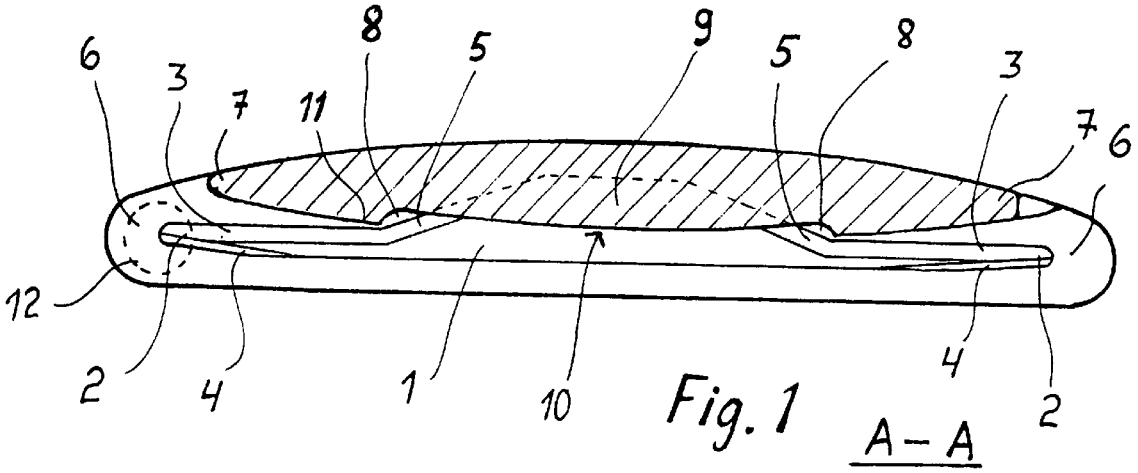
FIG. 1 is a longitudinal side section of the paperknife taken along the section line in FIG. 3.
Figure 3:
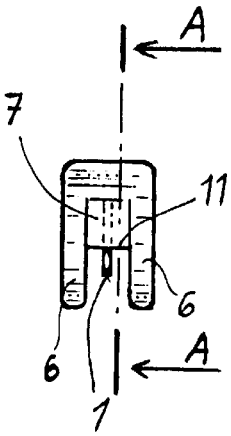
FIG. 3 is the paperknife viewed from one end.

FIG. 1 shows a paperknife with a longitudinal body, both ends of which are symmetric and furnished with sharpened blade portions 3. At both blade ends there are, side by side, body walls 6, which are better illustrated in the end view and in FIG. 2. Body walls 6 are at a suitable distance from each other for easy application of the envelope fold or, in most cases, the upper envelope edge between them. Anyhow, the distance is so small that there is not space enough to put a finger into it. Blade portion 3 with tip 2 are arranged between body walls 6 so that no portion of them reaches the upper level of body walls 6. Blade 1 is, as a whole, a symmetric double-blade. When at least the body walls 6 are made of transparent plastic or glass, tip 2 of blade portion 3 can be seen through these walls and tip 2 can be put accurately in the envelope from the start of fold and cutting can be started.

Most conveniently, the tip 2 of blade portion 3 is flat and rounded and so it does neither penetrate the fold nor stick out through the fold while cutting. Still it is so sharp that at the end of cutting it breaks itself easily out through the envelope side fold. Cutting can be continued with the knife by cutting also the sidefold, whereby the tip 2 of the paperknife is turned into the sidefold from a suitable spot at the end of the closing fold. Dotted lines in FIG. 1 show a possible hole 12 in part 6 presenting an alternative for transparency. Through the hole it is possible to make same observations.

Blade tip 2 is most conveniently sharpened flat to enable an easy push under the folded envelope-closing flap. Mostly, the extreme ends of these flaps have no layer of glue and so the blade tip 2 can be pushed in. Generally, the sharpened blade portion 3 of blade 1 does not at this instant cut the fold open. This is because the direction of blade portion 3 is substantially the same as the direction of the fold, i.e. the cutting direction. Blade portion 3 comes to its end and the direction of blade 1 changes in the sharpened blade portion 5, which actually cuts the fold. In the spot where blade portions 3,5 at an angle of of 135°–170° with respective to each other there is a guiding body section 7 most closely to the blade, at a distance of appr. 0,5–1 mm in the spot 11. This ensures that cutting is started immediatelly with blade portion 5. In the same way, from there on the body wall departs immediately from the blade and forms an opening 8 at blade portion 5. The opening 8 prevents blockings and ensures proper cutting. Blade tip 2 projects substantially farther to the end of knife than part 7. The rounded tip of part 7 works as a stopper and prevents the blade from being pushed too deep in the envelope and also eases putting of the blade under the folded flap by restricting the blade range to the envelope surface.

Below blade portion 3 there is also a sharpened bevelling 4 which helps to put blade 1 tip 2 and the blade into starting position for cutting if the fold is glued up to the edge or almost to the edge. In addition, it facilitates the blade tip 2 to penetrate the envelope wall at the final stage of cutting, whereby the tip 2 extrudes the side fold of the envelope when one does not want to cut the side fold.

The metal blade 1 is fixed by some known means to body 9, for instance with glue, screws or it is put in the mould when the body is cast. Due to the double-blade construction of the knife, it is well fit for use both by right-handed and left-handed people as it is always in proper cutting position.

In the body center there is a guiding section 10 against which the cut fold edges are gliding and the envelope keeps easily its direction during cutting.

Figure 2:
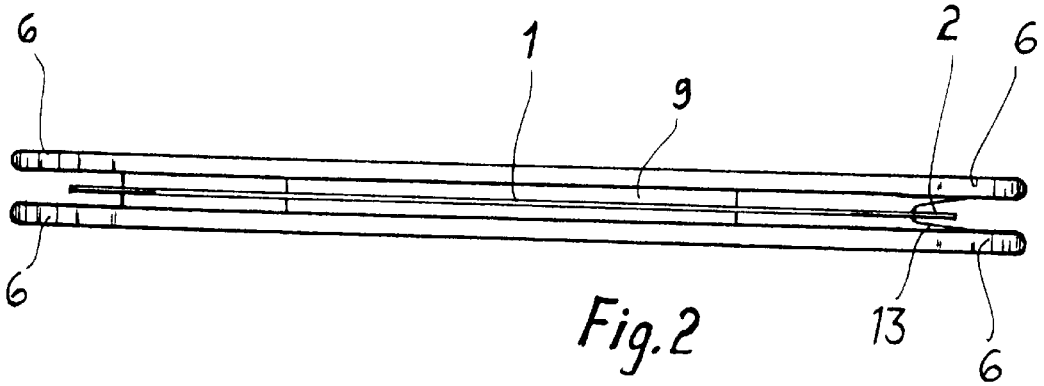
FIG. 2 is the paperknife viewed from the blade side.

FIG. 2 shows the knife viewed from one side of blade 1. In the right-hand end of the knife bevellings 13 are made to guide the envelope surface towards the blade 1 at the beginning of cutting, whereby it is easy to get the blade tip 2 under the flap in envelope.

Figure 4:
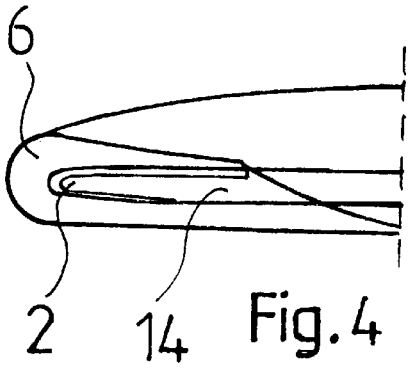
FIG. 4 is an alternative embodiment of the blade.

FIG. 4 shows a simple embodiment of an alternative blade 14 without an angle portion in its cutting edge.

In addition to opening an envelope, the knife can be used to cut paper, the paper must, however, be folded at first along the cutting line. The knife body is well fit for printing of images and is therefore also ideal as a sales promotion gift. One end of the knife can be designed as a key-holder, bottle opener etc, if the symmetric form is not required.

I claim:

1. A knife for cutting along a fold in a paper comprising:

an elongate body having a longitudinal axis and symmetric body ends, each said body end including two adjacent body walls on respective sides of the longitudinal axis and a guide device between said body walls which rides along the fold as the fold passes between said body walls parallel to the longitudinal axis;

an elongate blade fixed in said body and having respective free symmetric blade ends located at a respective said body end, each respective said blade end being completely located between said adjacent body walls of a respective said body end and including a blade tip and a sharpened cutting portion adjacent to said blade tip and to a respective said guide device, said sharpened cutting portion being formed of a first blade portion disposed parallel to the longitudinal axis and a second blade portion at an angle of 135°–170° to said first blade portion; and a viewing means for allowing each said blade tip to be viewed through an associated said body wall whereby insertion of said blade tip inside of the fold is viewable by a user.

2. A knife as claimed in claim 1 wherein said viewing means is a hole provided in one of said body walls of each said body end.

3. A knife as claimed in claim 1 wherein said viewing means is one of said body walls of each said body end which is made of a transparent material.

4. A knife as claimed in claim 1 wherein each said first blade portion includes a second sharpened cutting portion adjacent said blade tip and opposite to said guide device.

5. A knife as claimed in claim 1 wherein each said blade end of said blade extends longitudinally beyond the respective said guide device of the respective said body end.

* * * * *